US007198112B2

(12) United States Patent
Wanner

(10) Patent No.: US 7,198,112 B2
(45) Date of Patent: Apr. 3, 2007

(54) MINE SIFTING ATTACHMENT HAVING TRANSVERSE BLADES

(75) Inventor: Christopher J Wanner, Stafford, VA (US)

(73) Assignee: United States of America as Represented by the Department of the Army, Washington, DC (US)

( * ) Notice: Subject to any disclaimer, the term of this patent is extended or adjusted under 35 U.S.C. 154(b) by 216 days.

(21) Appl. No.: 10/786,139

(22) Filed: Feb. 26, 2004

(65) Prior Publication Data

US 2005/0189124 A1 Sep. 1, 2005

(51) Int. Cl.
*A01B 45/04* (2006.01)

(52) U.S. Cl. ..... 172/19; 171/46; 171/105

(58) Field of Classification Search ..... 171/19, 171/46, 105, 143, 144, 84, 86, 88, 91, 102, 171/104, 106, 107, 110, 70
See application file for complete search history.

(56) References Cited

U.S. PATENT DOCUMENTS 2,479,719 A * 8/1949 Boylan ..... 171/65
2,618,917 A * 11/1952 Howser ..... 298/23 R
2,693,746 A * 11/1954 Klein ..... 171/126
2,738,633 A 3/1956 Bestland et al. ..... 55/17
2,763,975 A 9/1956 Neigel ..... 55/17
4,257,486 A * 3/1981 Hobbs ..... 171/101
4,727,940 A * 3/1988 Bar-Nefy et al. ..... 171/84
5,189,243 A 2/1993 Hambric ..... 89/1.13
5,291,819 A * 3/1994 Hambric ..... 89/1.13
6,330,920 B1 12/2001 Wanner ..... 171/19

* cited by examiner

*Primary Examiner*—Victor Batson
(74) *Attorney, Agent, or Firm*—Andrew Romero

(57) ABSTRACT

An improved minesweeper having a two-sided frame adapted to be coupled to and pushed by a tractor and a rake pivoted from each side of the frame by respective pairs of coupling bars of different lengths so that as the rake moves away from the frame to bury itself in the soil, the coupling bars rotate it to a less aggressive digging angle that prevents the rake from stalling the tractor, wherein the improvement comprises apparatus connected to the frame for catching and sifting mines, soil, rocks and other objects buried in the soil passing over the rake without small amounts of vegetation and variances in soil conditions clogging the catching and sifting means.

12 Claims, 2 Drawing Sheets

MINE SIFTING ATTACHMENT HAVING TRANSVERSE BLADES

GOVERNMENT INTEREST

The invention described herein may be manufactured, used, sold, imported, and/or licensed by or for the Government of the United States of America.

BACKGROUND OF THE INVENTION

This invention relates in general to unearthing buried mines, and more particularly, to plow or rake mechanisms for unearthing buried mines.

My prior U.S. Pat. No. 6,330,920 B1 discloses an apparatus for clearing a minefield by sweeping aside the topsoil layer and collecting the mines that are uncovered. The minesweeper has a two-sided frame that is adapted to be pushed by a tractor. A rake is pivoted from each side of the frame by respective pairs of coupling bars of different lengths so that as the rake moves away from the frame to bury itself in the soil, the coupling bars rotate it to a less aggressive digging angle that prevents the rake from stalling the tractor. A sifting basket is disposed behind the rake and collects mines uncovered by the rake. A drawback to this equipment is that the sifting basket is often clogged by small amounts of vegetation and variances in soil conditions.

SUMMARY OF THE INVENTION

An object of the invention is to improve such equipment so as to avoid such drawback.

This and other objects of the invention are achieved in one aspect by an improved minesweeper having a two-sided frame adapted to be coupled to and pushed by a tractor and a rake pivoted from each side of the frame by respective pairs of coupling bars of different lengths so that as the rake moves away from the frame to bury itself in the soil, the coupling bars rotate it to a less aggressive digging angle that prevents the rake from stalling the tractor, wherein the improvement comprises means connected to the frame for catching and sifting mines, soil, rocks and other objects buried in the soil passing over the rake without small amounts of vegetation and variances in soil conditions clogging the catching and sifting means.

Another aspect of the invention involves an improved method of sweeping mines including the steps of pushing a two-sided frame with a tractor, and pivoting a rake from each side of the frame by respective pairs of coupling bars of different lengths so that as the rake moves away from the frame to bury itself in the soil, the coupling bars rotate it to a less aggressive digging angle that prevents the rake from stalling the tractor, wherein the improvement comprises the step of catching and sifting mines, soil, rocks and other objects buried in the soil passing over the rake without small amounts of vegetation and variances in soil conditions clogging the catching and sifting means.

BRIEF DESCRIPTION OF THE DRAWINGS

Additional advantages and features will become apparent as the subject invention becomes better understood by reference to the accompanying drawings, taken in conjunction with the accompanying description, in which similarly-referenced characters refer to similarly-referenced parts, and in which.

WRITTEN DESCRIPTION OF THE PREFERRED EMBODIMENT

Figure 1:
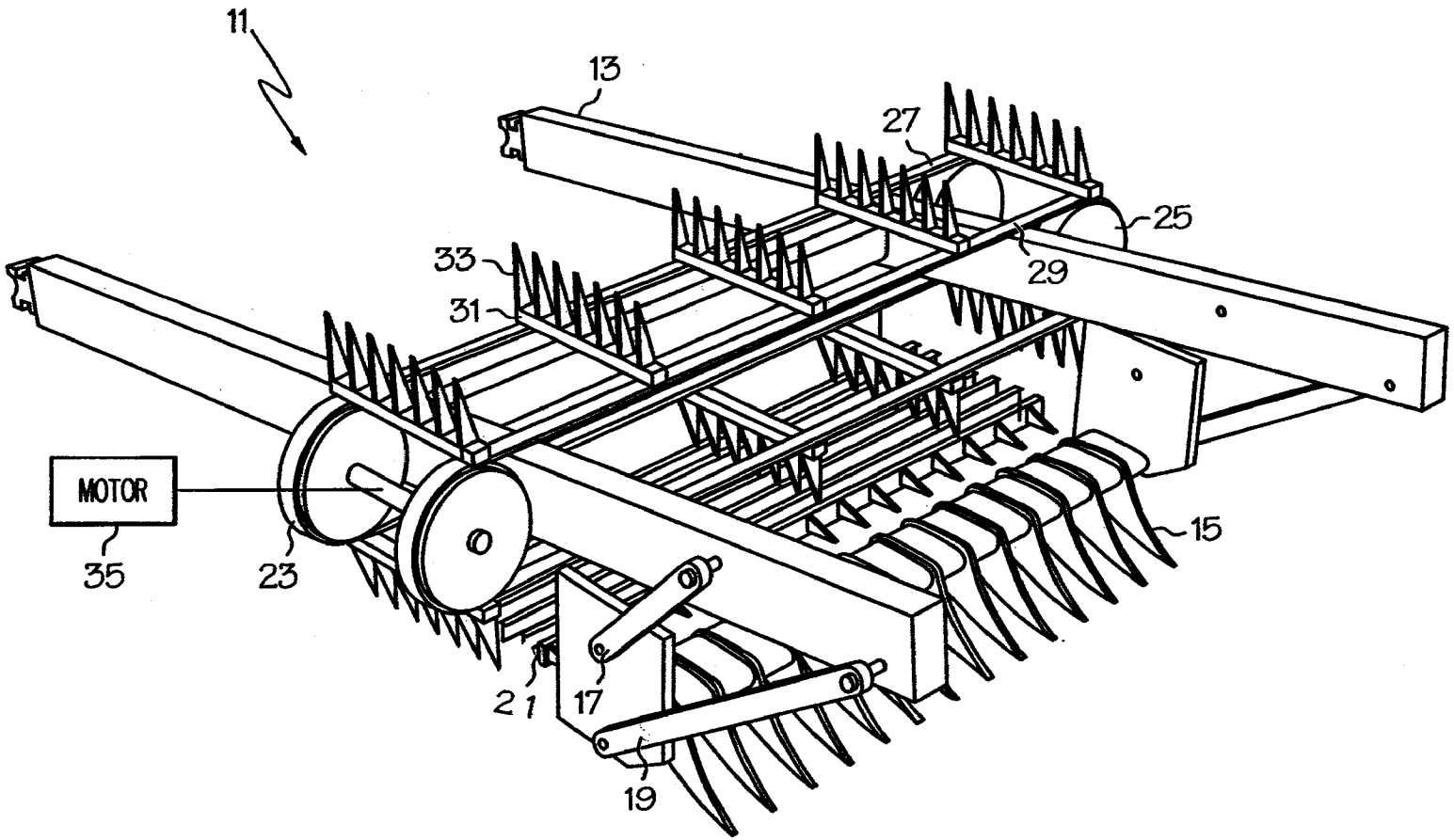
FIG. 1 is a schematic illustration of a minesweeper embodying the invention.
Figure 2:
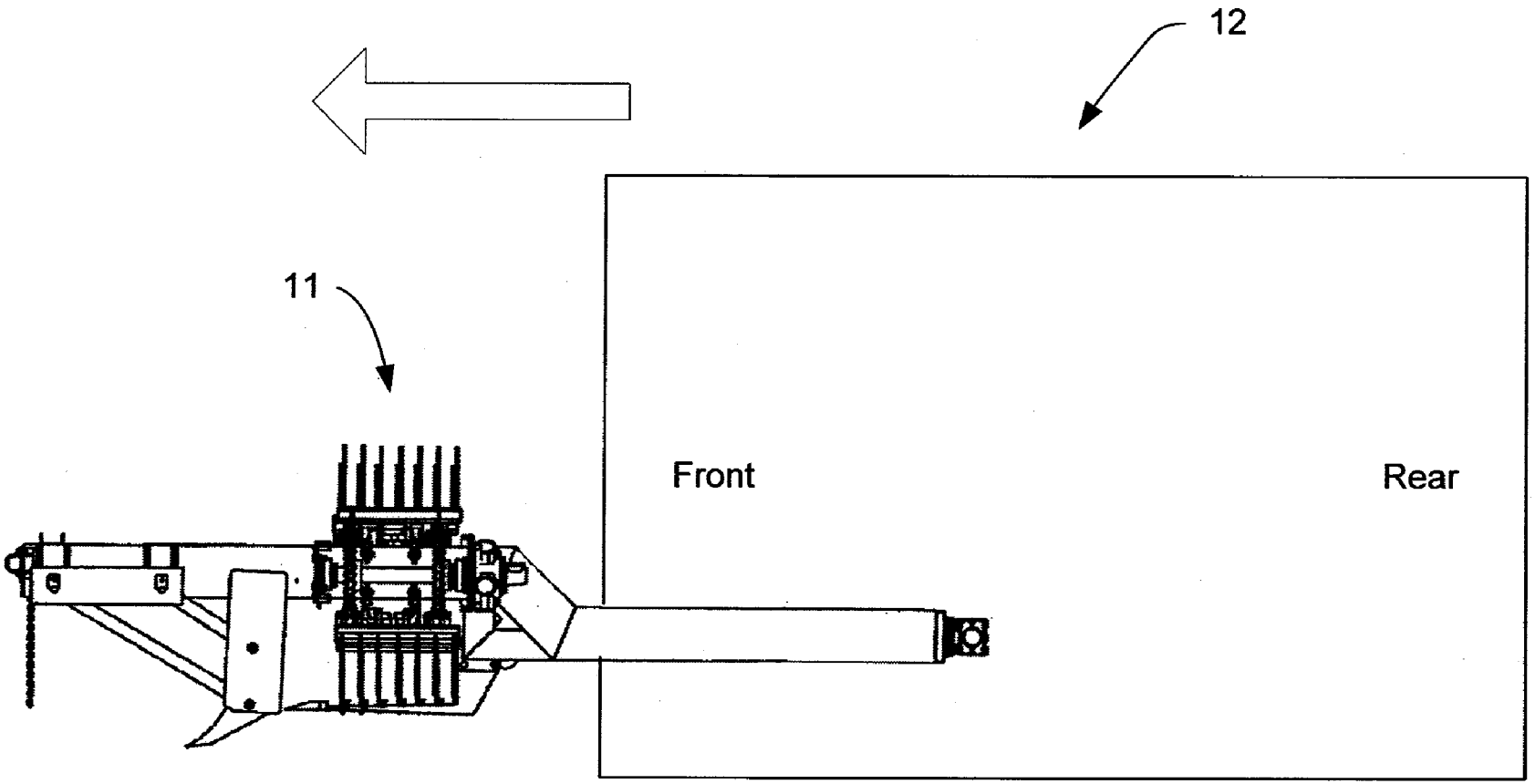
FIG. 2. is a schematic illustration of the minesweeper as it would be coupled to and pushed by a tractor in one embodiment.

FIGS. 1 and 2 show the minesweeper 11 incorporating the invention. The minesweeper has a two-sided frame 13 adapted to be coupled to and pushed by a tractor 12 (FIG. 2). A rake 15 is pivoted from each side of the frame by respective pairs of coupling bars 17 and 19 of different lengths so that as the rake moves away from the frame to bury itself in the soil, the coupling bars rotate it to a less aggressive digging angle that prevents the rake from stalling the tractor. The minesweeper as thus far described follows the teachings of my U.S. Pat. No. 6,330,920 B1, the disclosure of which is hereby incorporated by reference.

In accordance with the present invention, there is provided improvement by substituting for the sifting basket of the prior art minesweeper a novel means for catching and sifting mines, soil, rocks and other objects buried in the soil passing over the rake 15, so that small amounts of vegetation and variances in soil conditions do not clog the catching and sifting means.

While the catching and sifting means may take a variety of forms, conveniently it may take the form shown in the FIG. 1 of a plurality of spaced fixed vanes 21 running across the bottom of the frame 13 from one side of the frame to the other side, two pairs of rollers, one pair of rollers 23 mounted on the one side of the frame and the other pair of rollers 25 mounted on the other side of the frame, and a pair of endless chains 27 and 29 running across the top of the frame and around the rollers. In addition, the catching and sifting means includes a plurality of spaced beams 31 carried by the pair of chains, the beams lying across the spaced fixed vanes, a plurality of teeth 33 mounted on the beams, and a means 35, such as a hydraulic motor, for example a Kawasaki company model STAFFA HMB080 hydraulic motor, for turning the rollers.

In operation, the frame 13 is coupled to and pushed by a tractor 12 over a minefield (FIG. 2). The rake 15 moves away from the frame to bury itself in the soil and the coupling bars rotate it to a less aggressive digging angle. The rake 15 digs into the topsoil layer and mines, soil, rocks and other objects buried in the soil pass over the rake and are caught by the vanes 21. The hydraulic motor 35 turns the rollers 25 to move the chains 27 and 29 around a loop at two to four miles per hour (2–4 mph) so that the teeth 33 mounted on the beams 31 rake the soil and the objects sideways along the vanes 21, the teeth partially meshing with the vanes and forcing the soil to fall through while mines, and other objects larger than the vane spacing are carried along the tops of the vanes and are ejected to the side of the frame 13.

It is obvious that many modifications and variations of the present invention are possible in light of the above teachings. It is therefore to be understood that within the scope of the appended claims, the invention may be practiced otherwise than as described.

What is claimed is:

1. In a minesweeper having a two-sided frame adapted to be coupled to and pushed by a tractor and a rake pivoted from each side of the frame by respective pairs of coupling bars of different lengths so that as the rake moves away from the frame to bury itself in the soil, the coupling bars rotate the rake to a less aggressive digging angle that prevents the rake from stalling the tractor, means connected to the frame for catching and sifting mines, soil, rocks and other objects buried in the soil passing over the rake without small amounts of vegetation and variances in soil conditions clogging the catching and sifting means;

wherein the catching and sifting means includes, a plurality of spaced fixed vanes, wherein the frame has a top and a bottom and the vanes run across the bottom of the frame from one side of the frame to the other side, two pairs of rollers, one pair of rollers mounted on the one side of the frame and the other pair of rollers mounted on the other side of the frame, and a pair of endless chains running across the top of the frame and around the rollers.

2. The minesweeper recited in claim 1, wherein the catching and sifting means includes:

a plurality of spaced beams carried by the pair of chains, the beams lying across the spaced fixed vanes.

3. The minesweeper recited in claim 2 wherein the catching and sifting means includes:

a plurality of teeth mounted on the beams.

4. The minesweeper recited in claim 3 wherein the catching and sifting means includes:

means for turning the rollers to move the chains around a loop so the teeth mounted on the beams rake sideways along the vanes any mines, soil, rocks and other objects buried in the soil passing over the rake and caught by the vanes, the teeth partially meshing with the vanes and forcing the soil to fall through while mines, and other objects larger than the vane spacing are carried along tops of the vanes and are ejected to the side of the frame.

5. In a minesweeper having a two-sided frame with a top and a bottom and adapted to be coupled to and pushed by a tractor, and a rake pivoted from each side of the frame by respective pairs of coupling bars of different lengths so that as the rake moves away from the frame to bury itself in the soil, the coupling bars rotate the rake to a less aggressive digging angle that prevents the rake from stalling the tractor:

a plurality of spaced fixed vanes, wherein the vanes run across the bottom of the frame from one side of the frame to the other side;

two pairs of rollers, one pair of rollers mounted on the one side of the frame and the other pair of rollers mounted on the other side of the frame;

a pair of endless chains running across the top of the frame and around the rollers, a plurality of spaced beams carried by the pair of chains, the beams lying across the spaced fixed vanes;

a plurality of teeth mounted on the beams; and, a motor coupled to the rollers for turning the rollers to move the chains around a loop so the teeth mounted on the beams rake sideways along the vanes any mines, soil, rocks and other objects buried in the soil passing over the rake and caught by the vanes, the teeth partially meshing with the vanes and forcing the soil to fall through while mines, and other objects larger than the vane spacing are carried along tops of the vanes and are ejected to the side of the frame.

6. The minesweeper recited in claim 5 in combination with the tractor.

7. In a method of sweeping mines including the steps of:

pushing a two-sided frame with a top and a bottom and pivoting a rake from each side of the frame by respective pairs of coupling bars of different lengths so that as the rake moves away from the frame to bury itself in the soil, the coupling bars rotate the rake to a less aggressive digging angle; and catching and sifting mines, soil, rocks and other objects buried in the soil passing over the rake without small amounts of vegetation and variances in soil conditions clogging the catching and sifting means, wherein the catching and sifting step includes:

running a plurality of spaced fixed vanes across the bottom of the frame from one side of the frame to the other side, mounting one pair of rollers on one side of the frame, mounting another pair of rollers on the other side of the frame, and running an endless chain across the top of the frame and around the rollers.

8. The method of claim 7 wherein the catching and sifting step includes:

running another endless chain across the top of the frame and around the rollers.

9. The method of claim 8 wherein the catching and sifting step includes:

supporting a plurality of spaced beams on the pair of chains, the beams lying across the spaced fixed vanes.

10. The method of claim 9 wherein the catching and sifting step includes:

mounting a plurality of teeth on the beams.

11. The method of claim 10 wherein the catching and sifting step includes:

turning the rollers to move the chains around a loop so the teeth mounted on the beams rake sideways along the vanes any mines, soil, rocks and other objects buried in the soil passing over the rake and caught by the vanes, the teeth partially meshing with the vanes and forcing the soil to fall through while mines, and other objects larger than the vane spacing are carried along tops of the vanes and are ejected to the side of the frame.

12. The method of claim 11 wherein the frame is pushed by a tractor.

* * * * *